US006082838A

United States Patent [19]

Bissu-Palombo

[11] Patent Number: 6,082,838

[45] Date of Patent: Jul. 4, 2000

[54] FOLDABLE AND ASSEMBLEABLE DESK

[76] Inventor: Moises Bissu-Palombo, Poniente 128 No, 590 Fraccionamiento Industrial Vallejo, C.P. 02300, Mexico, D.F., Mexico

[21] Appl. No.: 09/263,540

[22] Filed: Mar. 8, 1999

[30] Foreign Application Priority Data

Oct. 12, 1998 [MX] Mexico ..... 98301

[51] Int. Cl.[7] ..... A47B 19/08

[52] U.S. Cl. ..... 312/195; 312/223.3; 312/262; 108/115; 108/50.01

[58] Field of Search ..... 108/115, 50.01, 108/50.02, 157.1, 157.16, 159.12, 150; 312/194, 195, 351.4, 223.3, 258, 262

[56] References Cited

U.S. PATENT DOCUMENTS

| | | | |
|---|---|---|---|
| 2,764,462 | 9/1956 | McDonald | 312/258 X |
| 3,809,449 | 5/1974 | Beaver | 312/194 |
| 4,317,416 | 3/1982 | Baum et al. | 108/157.1 |
| 4,747,644 | 5/1988 | Gallery et al. | 312/262 X |
| 5,205,223 | 4/1993 | Ball et al. | 108/124 |
| 5,562,050 | 10/1996 | Colquhoun | 108/115 |
| 5,626,323 | 5/1997 | Lechman et al. | 108/138 X |
| 5,769,514 | 6/1998 | Brown et al. | 312/223.6 X |
| 5,904,104 | 5/1999 | Yu | 108/116 |
| 5,954,412 | 9/1999 | Rutherford et al. | 312/258 |
| 5,967,054 | 10/1999 | Rosenfeld | 108/115 X |

FOREIGN PATENT DOCUMENTS

| | | | |
|---|---|---|---|
| 2543414 | 10/1984 | France | 108/115 |
| 2137488 | 10/1984 | United Kingdom | 108/115 |

*Primary Examiner*—Peter M. Cuomo
*Assistant Examiner*—Hanh V. Tran
*Attorney, Agent, or Firm*—Harrsion & Egbert

[57] ABSTRACT

A foldable desk assembly having a panel, a first leg hingedly attached to one end of the panel so as to be movable between a first position overlying a surface of the panel and a second position extending transverse to the panel, a second leg hingedly attached to an opposite end of the panel so as to be movable between a first position overlying the surface of the panel and a second position transverse to the panel. Each of the first and second legs includes a pair of spaced apart screws located at a top end thereof. A desktop has grooved formed therein so as to correspond to the location of the screws on the ends of the legs. Each of the screws can be inserted into the respective slots so as to allow the desktop to properly engage the top of the legs. A pair of tracks is formed on an underside of the desktop so as to allow for the receipt of a drawer therein.

11 Claims, 10 Drawing Sheets

FIG. 5A
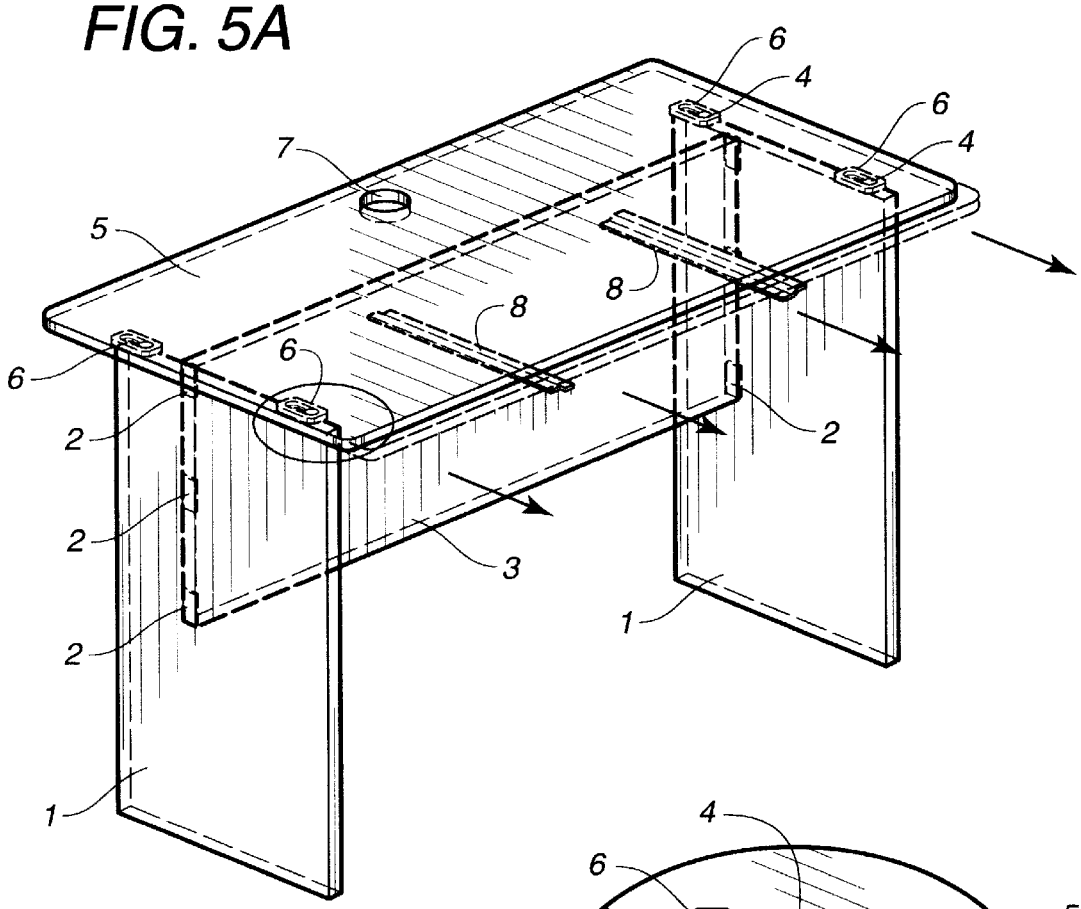
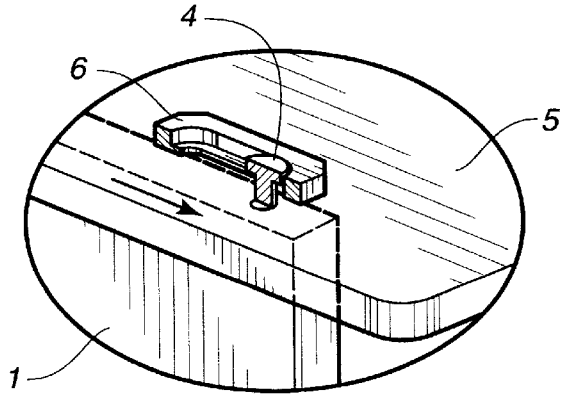
FIG. 5B

FIG. 6A
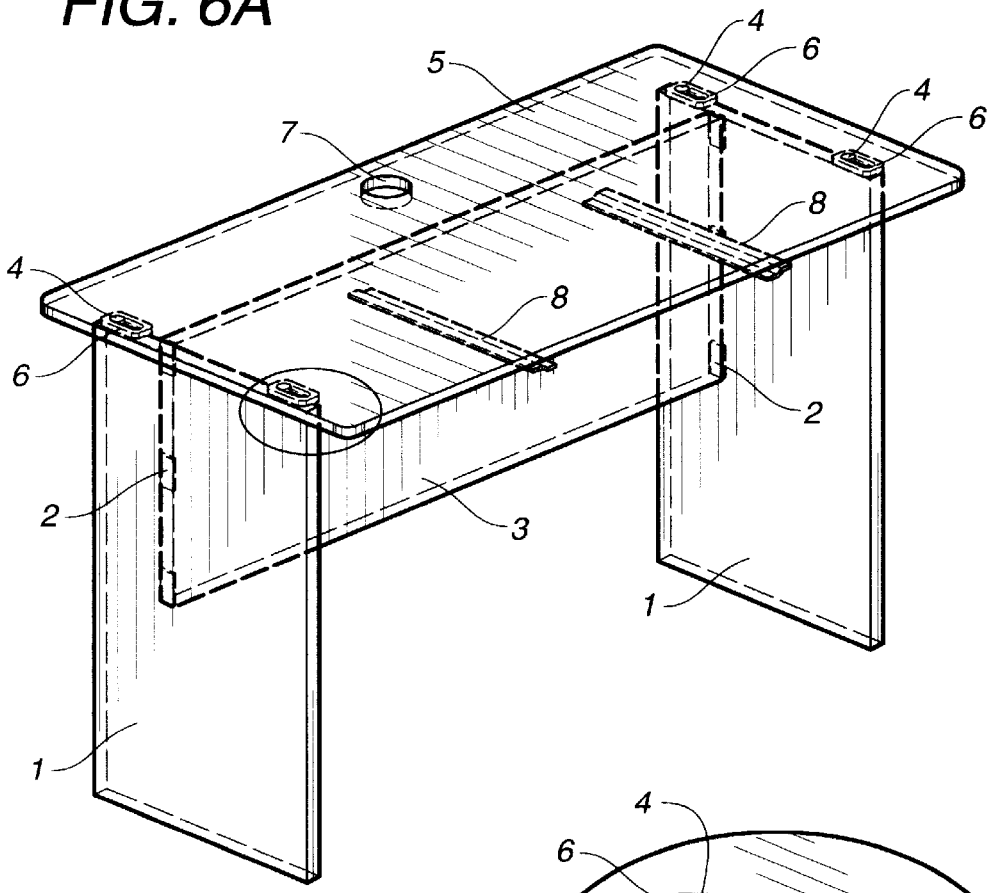
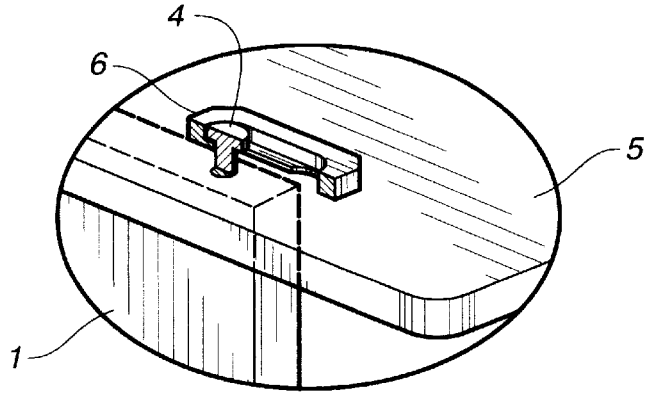
FIG. 6B

FIG. 7A
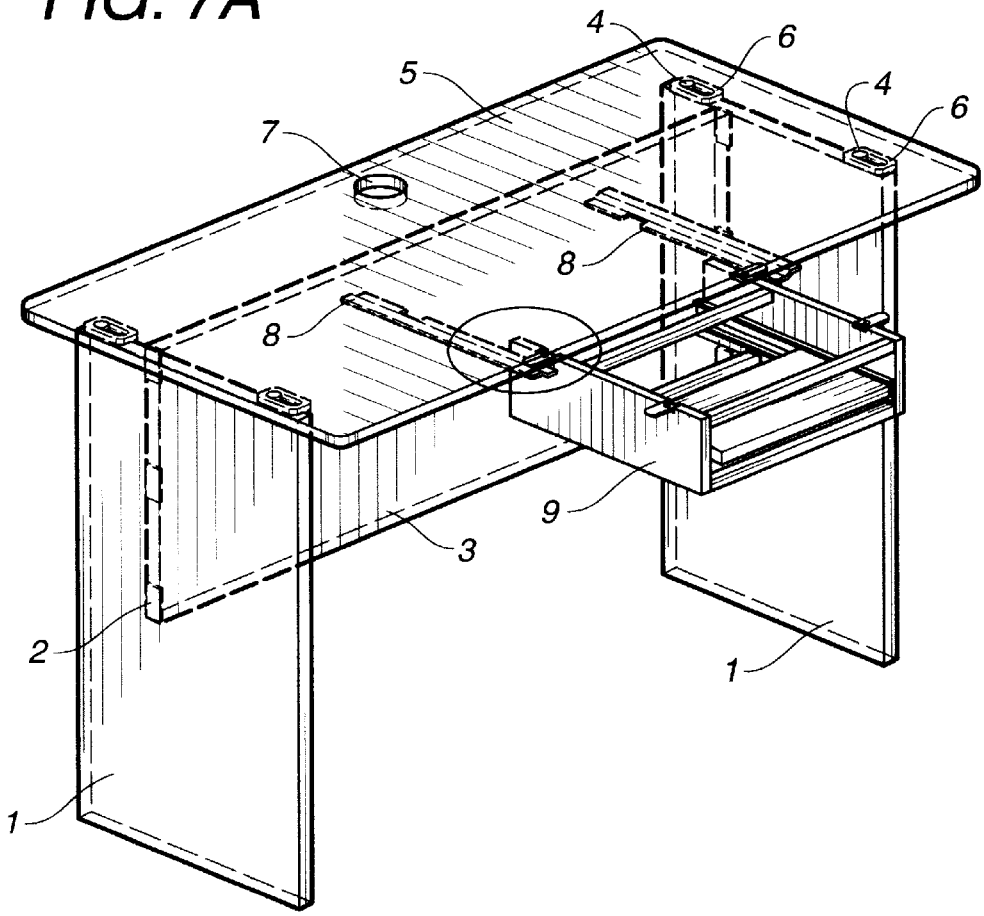
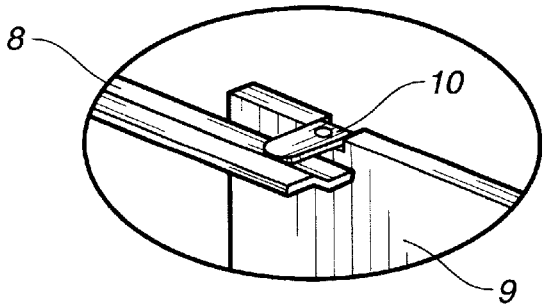
FIG. 7B

FIG. 8A
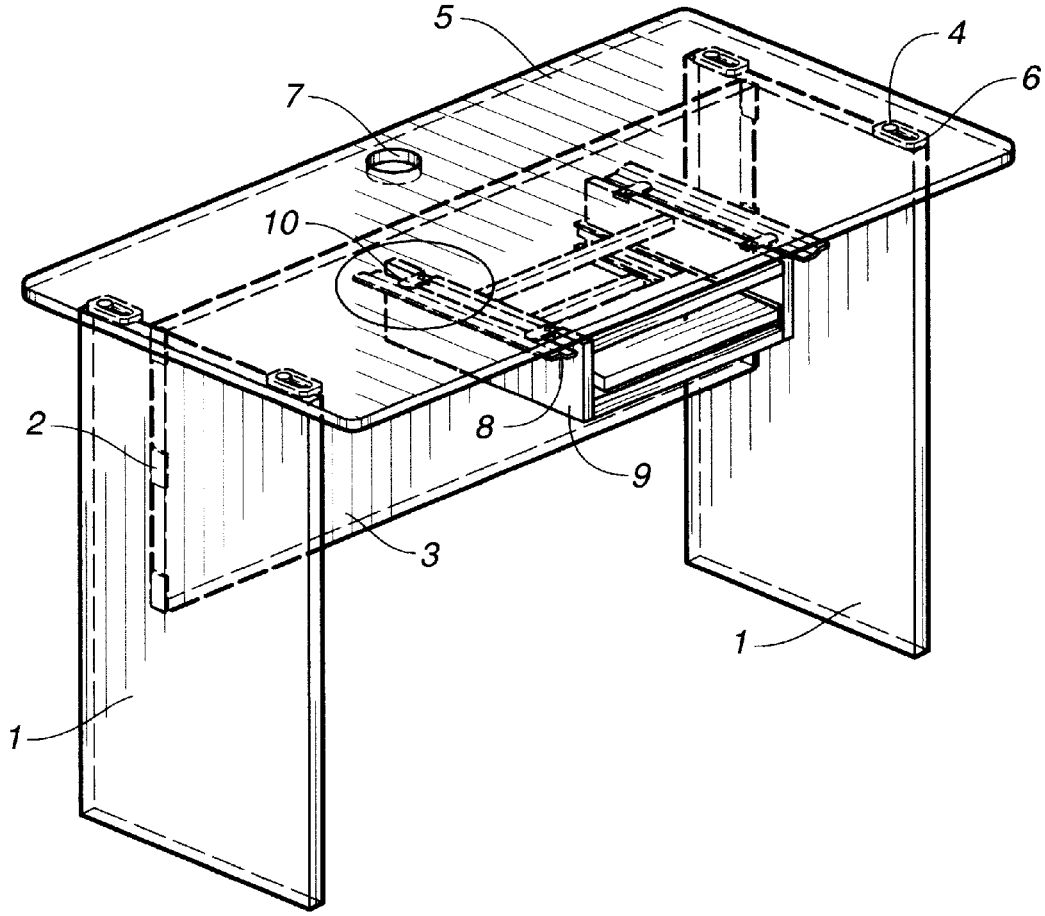
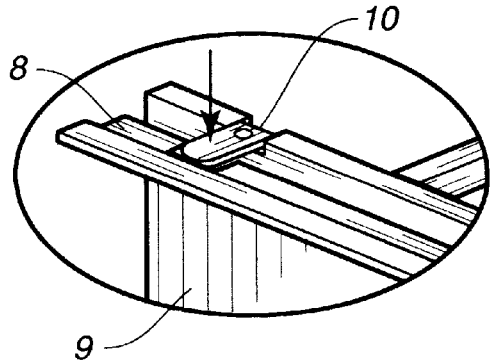
FIG. 8B

FOLDABLE AND ASSEMBLEABLE DESK

TECHNICAL FIELD

The present invention relates to desk assemblies. More particularly, the present invention relates to desks that can be unfolded and easily assembled.

BACKGROUND ART

Office furniture designs known today are very conventional. These office furniture designs are often boring and bothersome especially in small spaces available within the office environment.

There are no desks which allow for the optimal use of space within an office. The furniture which is now available is static and relatively large. Once the furniture is located in a desired area of an office, they cannot be rearranged to another place because of the heavy weight and large size. As a result, the office environment is often unprofitably occupied by such furniture.

Desks are often required to perform tasks such as schoolwork, home accounting or other tasks outside of the office environment. However, because of the lack of space available to place a desk, persons often find themselves using the dinner table. As a result, any tasks being carried out can become dirty or damaged because of food debris or become wet from any water residing on the dinner table surface.

Desks used in the office environment are not configured to occupy a required space and then be folded so that they can be stored in a closet or placed below any other piece of furniture. As such, existing desks do not optimize the space available.

It is an object of the present invention to provide a desk which is capable of being folded in order to occupy a minimum amount of space.

It is another object of the present invention to provide a desk that can be easily assembled without any tools.

It is a further object of the present invention to provide a desk having a minimal number of separated pieces.

It is still a further object of the present invention to provide a desk which facilitates the ability to transport the unassembled desk.

It is still another object of the present invention to provide a desk which can be easily folded so as to be moved into a desired area.

These and other objects and advantages of the present invention will become apparent from a reading of the attached specification and appended claims.

SUMMARY OF THE INVENTION

The present invention is a foldable desk assembly which includes a panel, a first leg hingedly attached to one end of the panel so as to be movable between a first position overlying a surface of the panel and a second position extending transverse to the panel, a second leg hingedly attached to an opposite end of the panel so as to be movable between a first position overlying the surface of the panel and a second position transverse to the panel, and a desktop of planar construction which can be removably affixed onto the top ends of each of the first and second legs. In particular, the first and second legs include spaced apart screws affixed to a top end thereof. The desktop includes a plurality of slots that are arranged so as to correspond with the location of the screws on the top ends of the legs. The desktop can be placed onto the legs such that the screw enters each of these slots. The desktop can then be moved forward so that the slot fixedly receives each of the screws therein. The slots have a circular orifice having a size slightly greater than a head of the corresponding screw. Each of the slots includes a slit extending from this orifice. The slit terminates in a stop at an end opposite the circular orifice.

The desktop of the present invention can include a pair of tracks arranged parallel to each other on an undersurface of the desktop. Each of these tracks releasably receives a tab affixed to a drawer. The drawer is slidably received within this pair of tracks. A cable hole is formed in the desktop rearwardly of the pair of tracks so as to allow cables from computers and telephones to extend therethrough.

BRIEF DESCRIPTION OF THE DRAWINGS

FIG. 5A is a perspective view showing the attachment of the desktop onto the legs of the desk of the present invention.

FIG. 5B is a detailed view showing how the slot on the desktop receives the screw affixed to the legs.

FIG. 6A is an illustration showing the securement of the desktop onto the legs.

FIG. 6B is a perspective detailed view showing the sliding of the screw within the slot of the desktop.

FIG. 7A is a perspective view showing the introduction of a drawer into the desk of the present invention.

FIG. 7B is a perspective detailed view of a tab associated with the drawer as received within a track affixed to the underside of the desktop.

FIG. 8A is a perspective view showing the sliding of the drawer into the track of the desk of the present invention.

FIG. 8B is a detailed view showing the placement of the tab of the drawer within the track.

DETAILED DESCRIPTION OF THE PRESENT INVENTION

Figure 1:
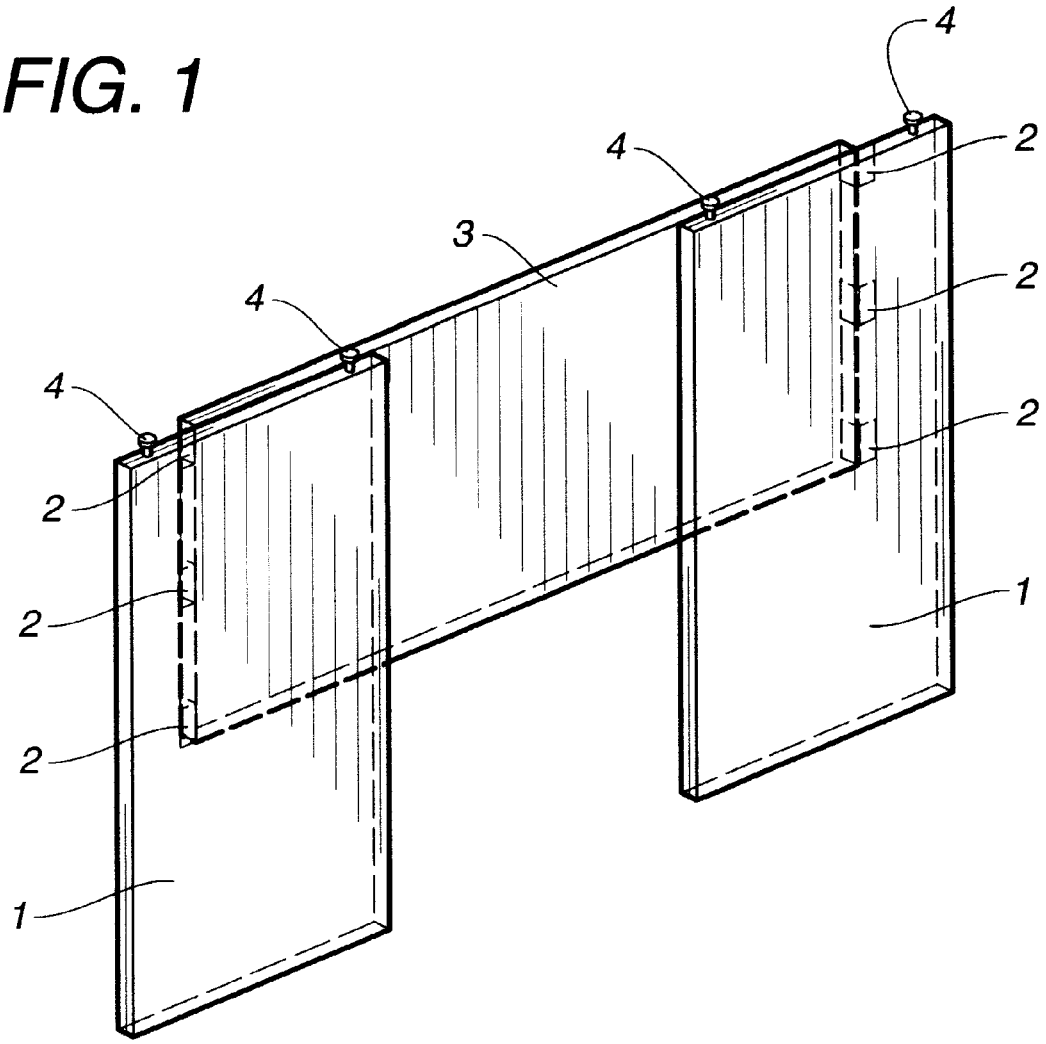
FIG. 1 is a perspective view showing the desk of the present invention in its unfolded unassembled condition.

Referring to FIG. 1, there is shown an isometric view of the desk of the present invention in its unfolded state. There are two legs 1 formed by vertical rectangular panels. Hinges 2 join the legs 1 to the horizontal rectangular panel 3 which is the frontal portion of the desk. Four screws 4 are arranged in pairs on the upper ends of each of the legs 1.

Figure 2:
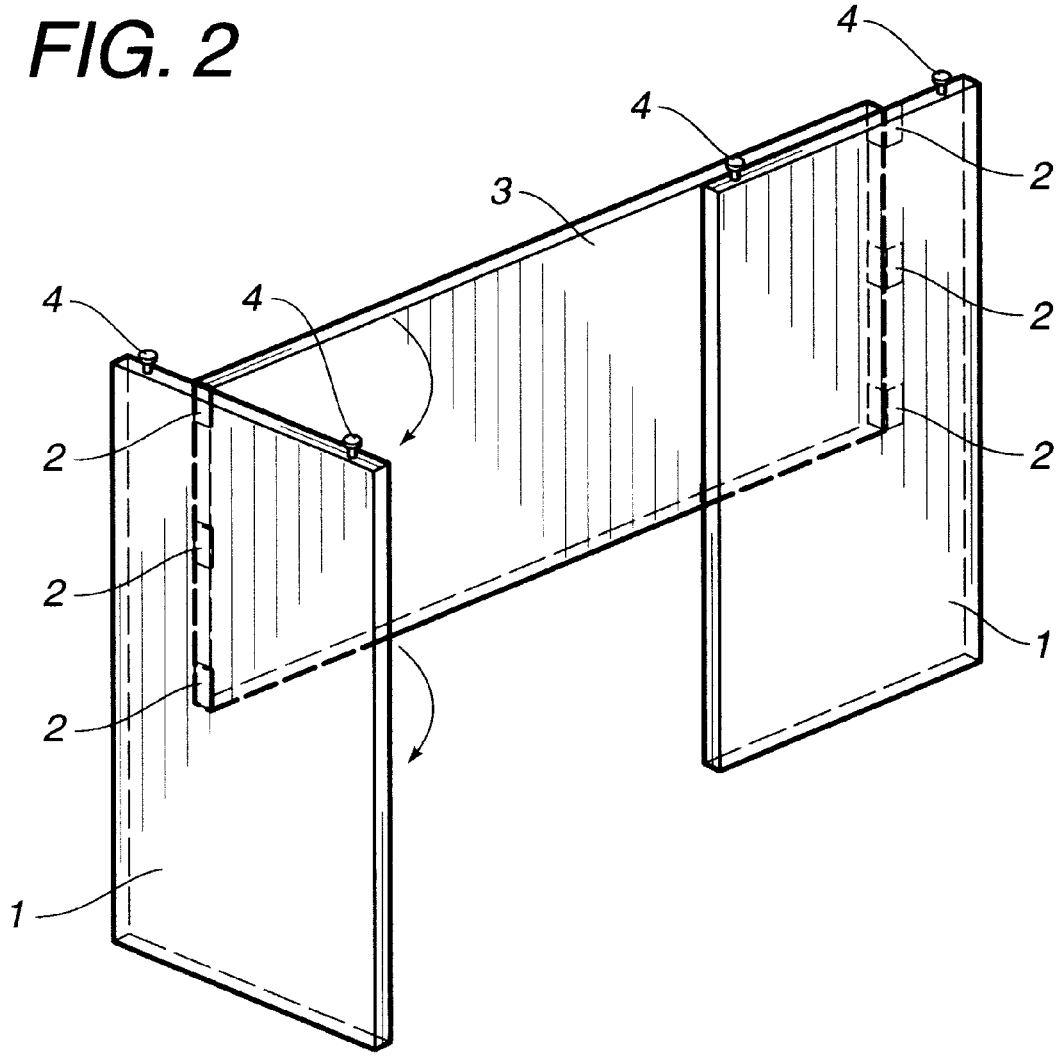
FIG. 2 illustrates the desk of the present invention with one leg being unfolded.

FIG. 2 illustrates the first step for the unfolding of the base of the desk of the present invention. In FIG. 2, it can be seen that the leg 1 is rotated about the hinges 2 so as to move from a position overlying the surface of the panel 3 to a position transverse to the plane of the panel 3. As can be seen, the opposite leg 1 resides in an overlying relationship with the surface of the panel 3.

Figure 3:
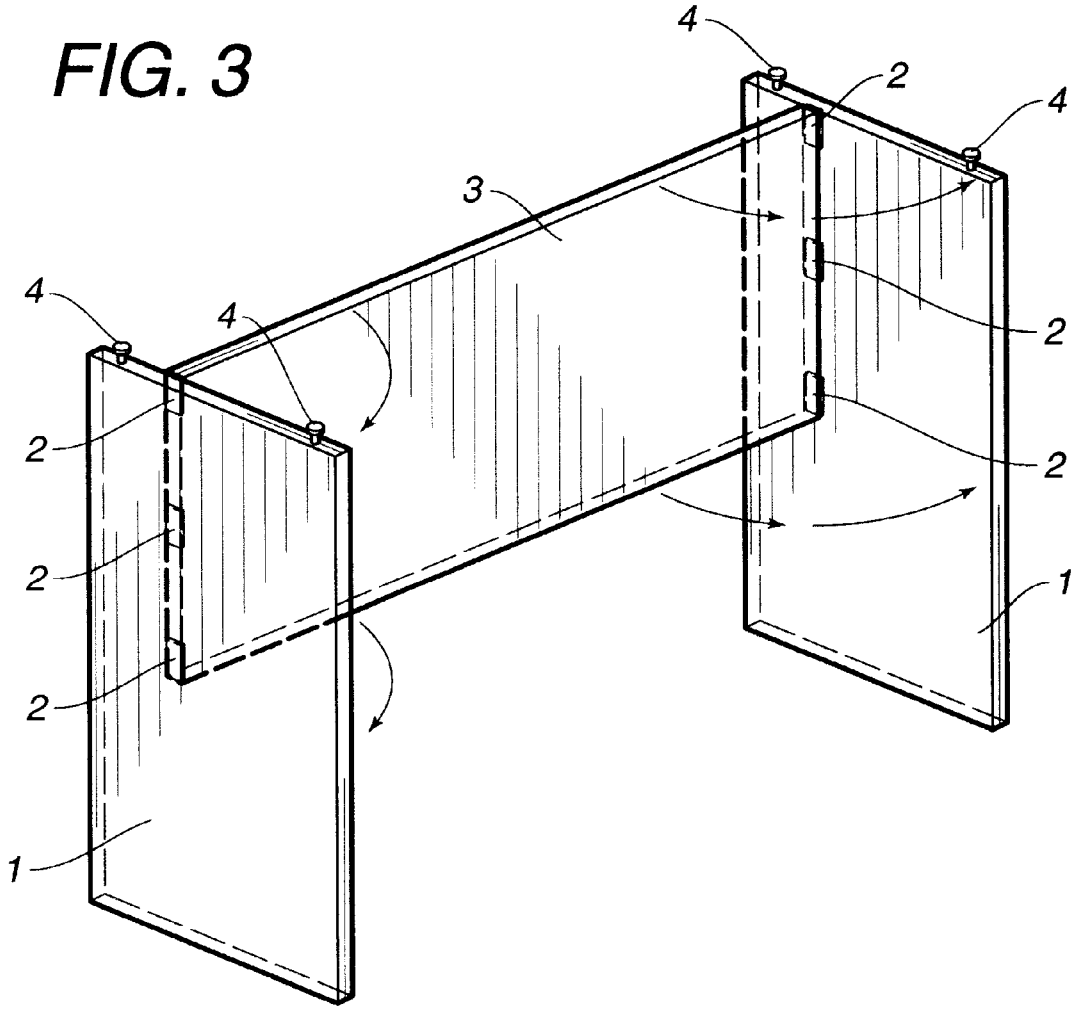
FIG. 3 is a perspective view showing the desk of the present invention with both legs unfolded.

FIG. 3 is a continuation of the first step which results in the unfolding of the opposite leg 1. The opposite leg 1 is rotated about hinges 2 so as to reside in a position perpendicular to the plane of the panel 3. In the position shown in FIG. 3, the unfolded base is suitable for the receipt of the desktop 5.

Figure 4A:
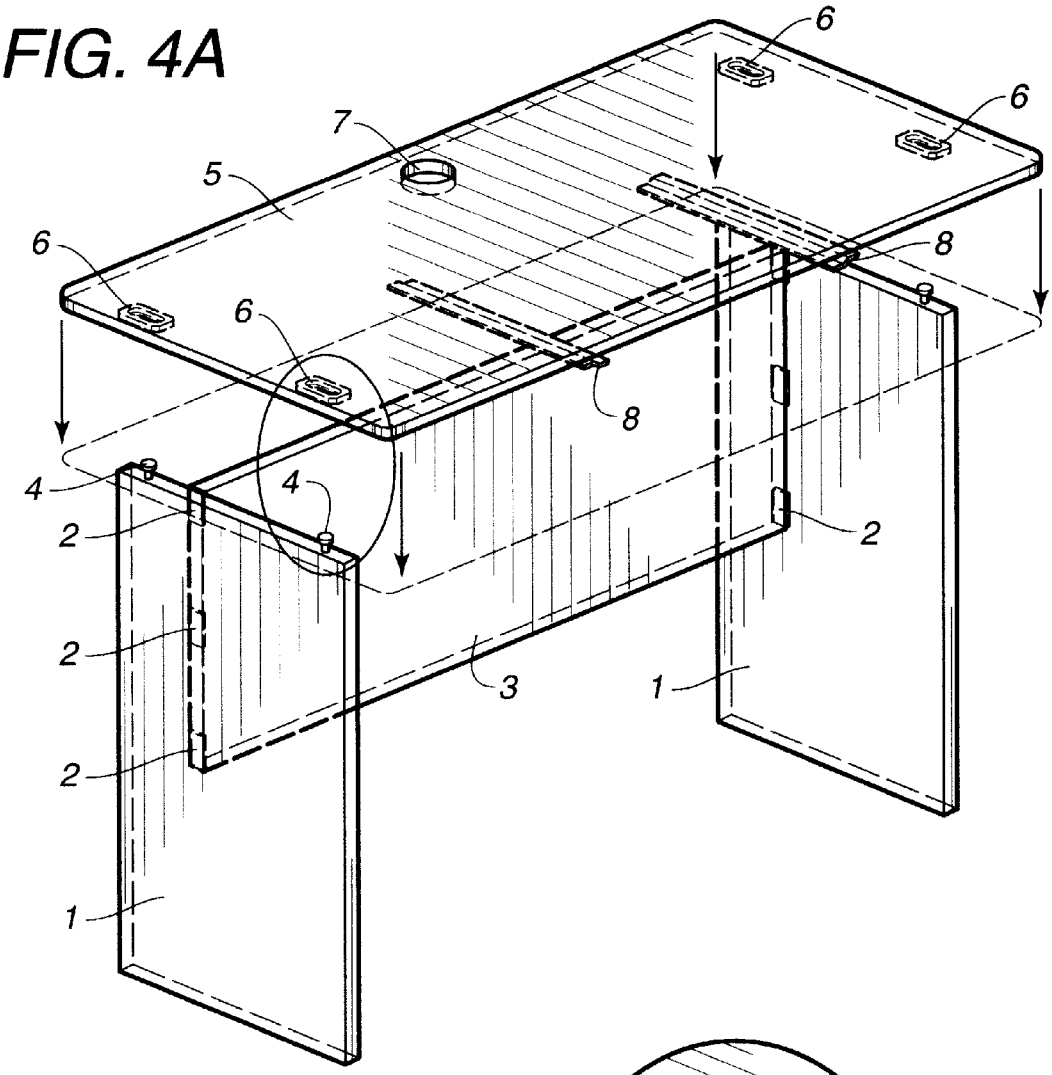
FIG. 4A shows a perspective view of the desk of the present invention showing the placement of the desktop upon the legs.

In FIG. 4A, it can be seen that the desktop 5 is positioned for attachment to the top of the legs 1 and, in particular, onto screws 4 located at the top of each of the legs 1. As can be seen, the desktop includes slot 6 arranged so as to correspond in location to the screws 4 located on the legs 1. The desktop 5 includes a cable hole 7 formed therein and extending through the thickness of the desktop 5. Slides or tracks 8 are affixed to an underside of the desktop 5 in a position suitable for the receipt of a drawer therein. The tracks 8 are affixed to the underside of the desktop 5 so as to reside in parallel relationship to each other. When assembled, the tracks 8 will reside forward of the panel 3 while the cable hole 7 will reside rearward of the panel 3.

Figure 4B:
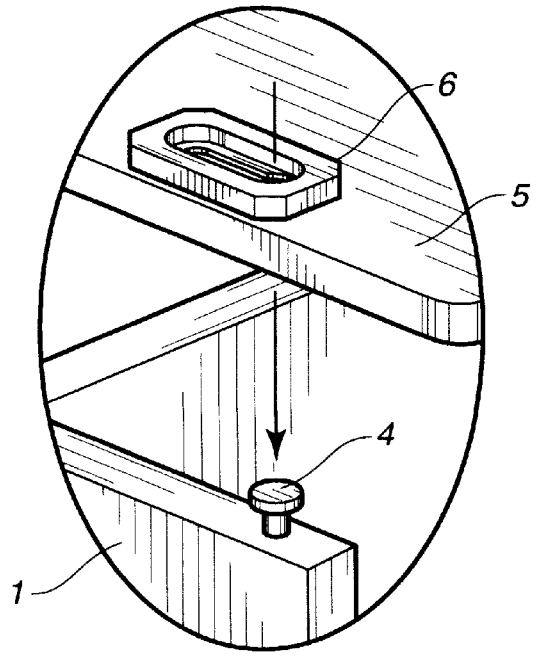
FIG. 4B is a detailed perspective view showing the attachment of the screw on a respective leg into a slot formed on the desktop.

FIG. 4B shows how the screw 4 located on the leg 1 can be inserted into the slot 6 formed on the desktop 5.

FIG. 5A shows the next step in the assembling of the desk of the present invention. As can be seen, the top 5 is positioned onto the top surface of the legs 1 such that the screws 4 will extend through an orifice formed in the slots 6. In FIG. 5B, it can be seen that the slot 6 has an orifice at its forward end having a diameter slightly greater than the head of the screw 4. As such, when placed upon the legs 1, each of the slots 6 in the desktop 5 will fit directly over the heads of each of the screws 4 so that the undersurface of the desktop 5 will reside in contact with the top surface of the legs 1. FIG. 5B also shows that a slit extends rearward from the screw head-receiving orifice.

FIG. 6A shows the next step for the assembly of the desk of the present invention. The desktop 1 is pulled forward so as to slide along the top surface of the legs 1. As this occurs, the shank of the screw 4, as shown in FIG. 6B, will move through the slit extending from the circular orifice of the slot 6. The head of screw 4 will reside against a stop formed at an opposite end of the slit from the circular orifice. As such, the desktop 5 will reside in a fixed position upon the legs 1. The screw remains static so as to make the desktop 5 in a fixed position to the base.

FIG. 7A shows how a drawer 9 can be applied to the desk of the present invention. Reference to FIG. 7B, the drawer 9 can be attached to the tracks 8 by simply inserting a tab 10 into the tracks 8. FIG. 7B shows the left side of the drawer 9 as received within the left side tracks 8. A similar arrangement will occur with respect to the right side tracks associated with drawer 9. The tracks 8 and the drawer 9 will extend from the forward end of the desktop 5 so as to allow for the receipt of items therein.

FIG. 8A shows how the drawer 9 can be moved through the tracks 8 so as to reside entirely below the desktop 5 in a closed position. As seen in FIG. 8B, the tab 10 will be received within a groove located at the end of the track 8 so as to cause the drawer 9 to be fixed in its closed position. A forward pulling force can be used so as to remove the tab 10 from the groove located at the back of the track 8.

Figure 9:
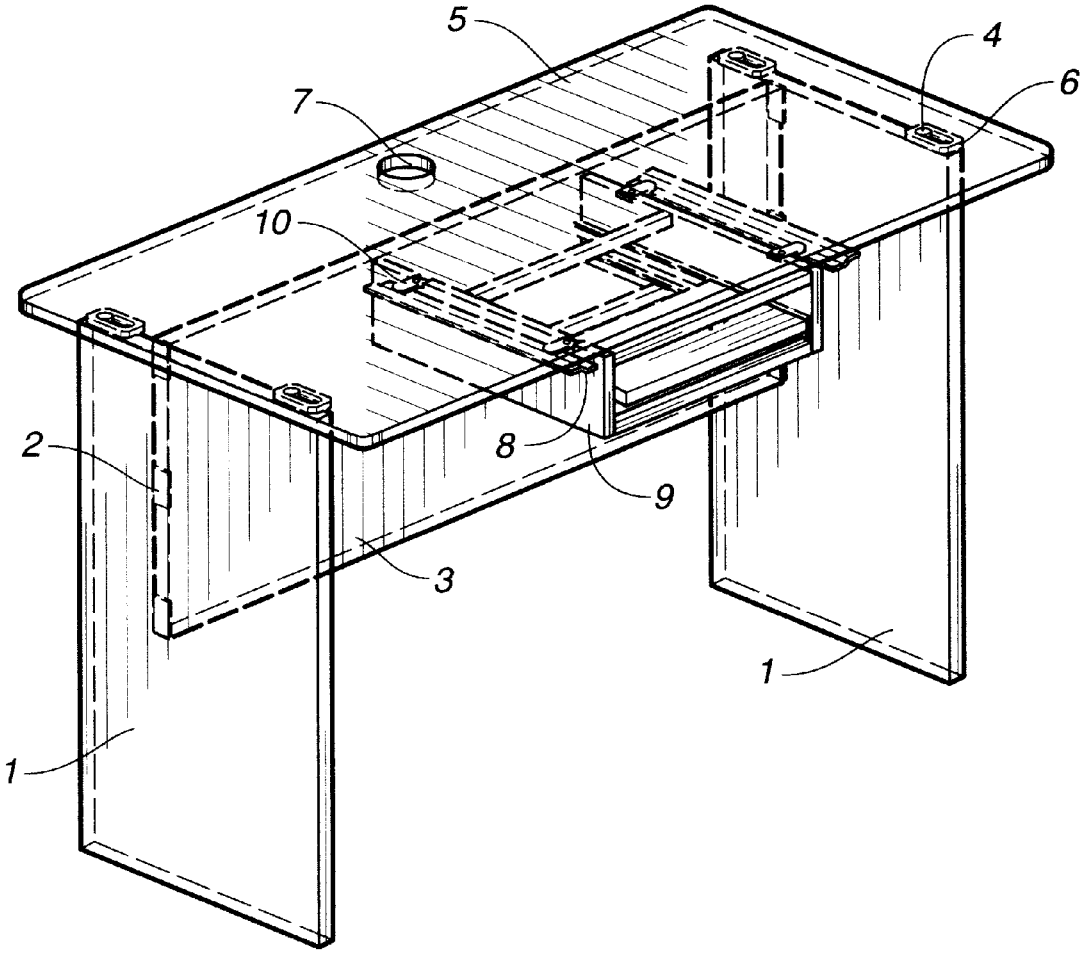
FIG. 9 is a perspective view showing the entire assembly of the desk of the present invention.
Figure 10:
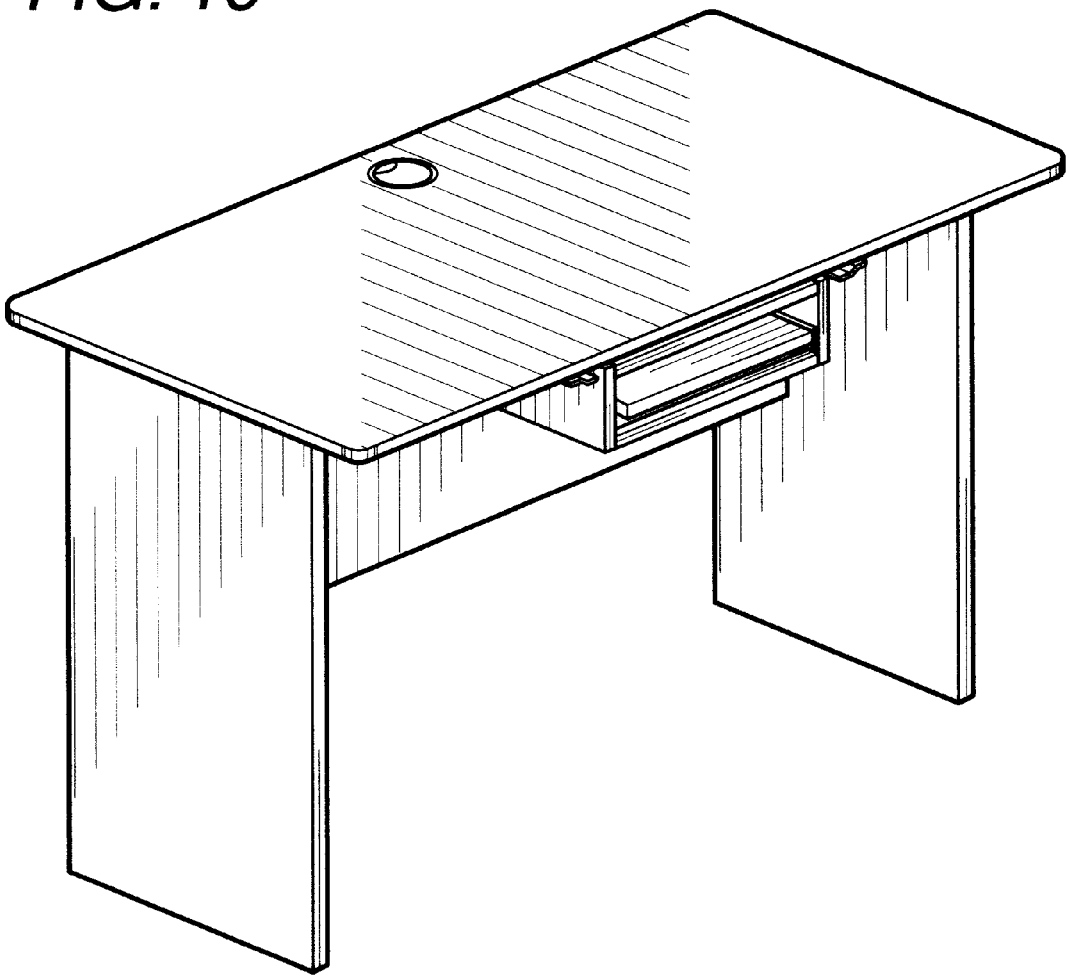
FIG. 10 is a solid perspective view of the assembled desk of the present invention.

FIG. 9 illustrates the complete assembly of the desk of the present invention in its final condition. FIG. 10 also shows the complete assembly of the present invention in solid view so that the various components are obscured from view. As can be seen, the desk 10 has a pleasing aesthetic appearance, a compact size, and maximum utility.

The desk of the present invention includes a main structure having the pieces joined together. Each of these pieces is formed of rectangular panels. The legs 1 are vertically arranged and serve as the desk stands or legs. Each of these legs 1 is linked by three hinges 2 to the panel 3. Each of the vertical legs 1 is provided on its upper edge with two screws 4 placed in spaced apart relationship on the end of the respective legs 1. These screws will act as "males" and will be joined to slots 6 arranged in the same position on the desktop 5.

The desktop 5 is a rectangular panel which can be independent of the main structure. The desktop has, at each of its ends, a slot 6 acting as a "female" so as to receive the screws 4 attached to the legs 1. Screws 4 are complementary to grooves 6 so as to allow the main structure (formed by the legs 1 and by the panel 3) and the desktop 5 to be fixedly joined together. Because of the unique shape of the slots 6, the screws 4 are assembled into the slots through the circular orifice and then slide through the slit extending after the orifice. The screws then have their shanks extending through the slit and the head emerging on the top of the slit.

The desktop 5 has a hole or orifice 7 through which the user can pass cables of the various appliances located on the desk. This cable hole 7 can receive the cables of computers, printers, tape recorders, and similar devices.

The desktop 5 can be provided on its undersurface with two tracks or slides 8 centrally positioned and arranged parallel to each other. A drawer having respective tabs 10 can be placed within each of these tracks 8 on each side of the drawer 9. As such, the drawer 9 can be moved forward and rearward in a sliding manner.

The main advantage of the present invention is its functionality by being able to be folded and unfolded whenever the user desires to make use of it. The mechanism is very simple because of the way each piece is configured. The user does not require any tools for the assembly of the desk since the pieces only have to complement each other by unfolding or by inserting one into the other.

The method of the present invention involves, initially, the unfolding by opening each leg 1 from the panel 3 so that the legs reside in perpendicular relationship to the panel 3. The desktop 5 is joined to the legs 1 and to the panel 3 by inserting screws 4 of the legs into slots 6 located on the desktop. The desktop 5 is then slid forward so as to cause the screws 4 to run throughout horizontal slits of the slots 6 until the stop of the slit is reached. This causes the desktop 5 to remain fixed. Once the desk is unfolded and assembled, the drawer 9 can be located by inserting the tabs 10 of the drawer 9 into the tracks 8 of the desktop 5. As a result, the drawer 9 can be slided rearward or forward along the tracks 8. Once these steps have been carried out, the user is able to make use of the desk of the present invention during a desired period of time. When it is desired to store the desk, it is only necessary to fold it in the manner opposite to that described hereinbefore and then storing the desk in a flat condition in any desired location.

I claim:

1. A foldable desk assembly comprising:

a panel;

a planar first leg hingedly attached to one end of said panel so as to be movable between a first position overlying a surface of said panel and a second position extending transverse to said panel, said panel positioned between edges of said first leg in said second position, said first leg having a spaced apart pair of screws affixed to a top end of said first leg;

a planar second leg hingedly attached to an opposite end of said panel so as to be movable between a first position overlying said surface of said panel and a second position transverse to said panel, said panel positioned between edges of said second leg in said second position of said second leg, said second leg having a spaced apart pair of screws affixed to a top end of said second leg; and a desktop of planar configuration, said desktop having a first pair of slots formed adjacent one end thereof, said first pair of slots slidably receiving respectively said pair of screws of said first leg such that said slot is interposed between a head of a respective screw and said top end of said first leg, said desktop having a second pair of slots formed adjacent an opposite end thereof, said second pair of slot slidably receiving respectively said pair of screws of said second leg such that each of said second pair of slots is interposed between a head of a respective screw and said top end of said second leg, said desktop being detachably affixed onto said first and second legs when said first and second legs are in said second position transverse to said panel.

2. The assembly of claim 1, each of said first and second pairs of slots having a circular orifice having a size slightly greater than a head of a corresponding screw, each of said first and second pairs of slots having a slit extending from said orifice, said slit having a stop at an end opposite said circular orifice, said slit having a width slightly greater than a shank of said screw.

3. The assembly of claim 2, each of said pair of screws on said first leg having a shank extending through said slit of a respective slot on said desktop and a head residing adjacent said stop in said second position.

4. The assembly of claim 1, said desktop having an upper surface and a bottom surface, said desktop having a pair of tracks arranged parallel to each other, each of said pair of tracks releaseably receiving a tab affixed to a drawer, said drawer being slidably received within said pair of tracks.

5. The assembly of claim 4, said pair of tracks positioned forward of said panel when said desktop is attached to said pair of legs in said second position.

6. The assembly of claim 1, each of said first and second legs being of a rectangular configuration.

7. The assembly of claim 4, said pair of tracks positioned centrally of said desktop.

8. The assembly of claim 4, said desktop having a cable hole extending therethrough rearward of said pair of tracks, said cable hole positioned on an opposite side of said panel from said pair of tracks when said desktop is affixed to said first and second legs in their second position.

9. A method of assembling a desk comprising the steps of:

rotating a planar first leg hingedly about an end of a panel such that said first leg resides perpendicular to said panel and said panel resides between edges of said first leg;

rotating a planar second leg hingedly about an opposite end of said panel such that said second leg resides perpendicular to said panel and parallel to said first leg and such that said panel resides between edges of said second leg, said first leg having a pair of screws affixed at a top end thereof, said second leg having a pair of screws affixed to a top end thereof;

placing a desktop onto said top ends of said first and second legs such that slots on said desktop engage corresponding screws on said first and second legs; and sliding said desktop along said top ends of said first and second legs such that the screws are engaged within respective slots in said desktop such that a slot is interposed between a head of a respective screw and a respective top end of said first and second legs.

10. The method of claim 9, further comprising:

affixing a pair of tracks in parallel relation onto an undersurface of said desktop; and inserting a tab of a drawer into each of said pair of tracks.

11. The method of claim 9, further comprising:

forming a cabled hole in said desktop so as to open on a top surface of said desktop.

* * * * *